US005232137A

United States Patent [19]

Devine

[11] Patent Number: 5,232,137

[45] Date of Patent: Aug. 3, 1993

[54] APPARATUS FOR CARRYING A SPRAY CAN

[76] Inventor: Mark E. Devine, 154 N. Catamaran Cir., Pittsburg, Calif. 94565

[21] Appl. No.: 820,200

[22] Filed: Jan. 13, 1992

[51] Int. Cl.[5] ..... A45F 5/00

[52] U.S. Cl. ..... 224/252; 224/148; 224/242; 224/247; 224/251; 248/313; 248/311.3; 222/175

[58] Field of Search ..... 224/148, 242, 245, 246, 224/247, 248, 251, 252, 253, 226, 272, 42.45 R, 42.46 R; 248/313, 311.2, 311.3, 314; 222/175, 180, 179.5; 220/737, 740, 481, 480, 212; 215/100.5

[56] References Cited

U.S. PATENT DOCUMENTS

| | | | |
|---|---|---|---|
| 969,524 | 9/1910 | Condon . | |
| 1,605,195 | 11/1926 | Lewis . | |
| 1,966,648 | 7/1934 | Ryberg | 248/313 |
| 2,248,513 | 7/1941 | Riley | 248/311.2 |
| 2,513,029 | 6/1950 | Lapointe | 220/481 |
| 2,815,047 | 12/1957 | Howard | 248/313 |
| 3,637,120 | 1/1972 | Clay . | |
| 4,830,247 | 5/1989 | Banks . | |
| 4,951,857 | 8/1990 | Carr | 224/242 |
| 4,955,518 | 9/1990 | Parsons et al. . | |
| 4,993,611 | 2/1991 | Longo . | |

FOREIGN PATENT DOCUMENTS

| | | | |
|---|---|---|---|
| 181763 | 4/1955 | Austria . | |
| 214297 | 3/1961 | Austria | 248/313 |

*Primary Examiner*—Linda J. Sholl
*Attorney, Agent, or Firm*—Thomas R. Lampe

[57] ABSTRACT

Apparatus for carrying a spray can including an elongated support element, a receptacle for receiving the end of the spray can having a spray valve element and flexible arms for releasably retaining the spray can in position. The receptacle and the flexible arms are releasably attached at predetermined locations on the elongated support element by flexible lock elements.

9 Claims, 3 Drawing Sheets

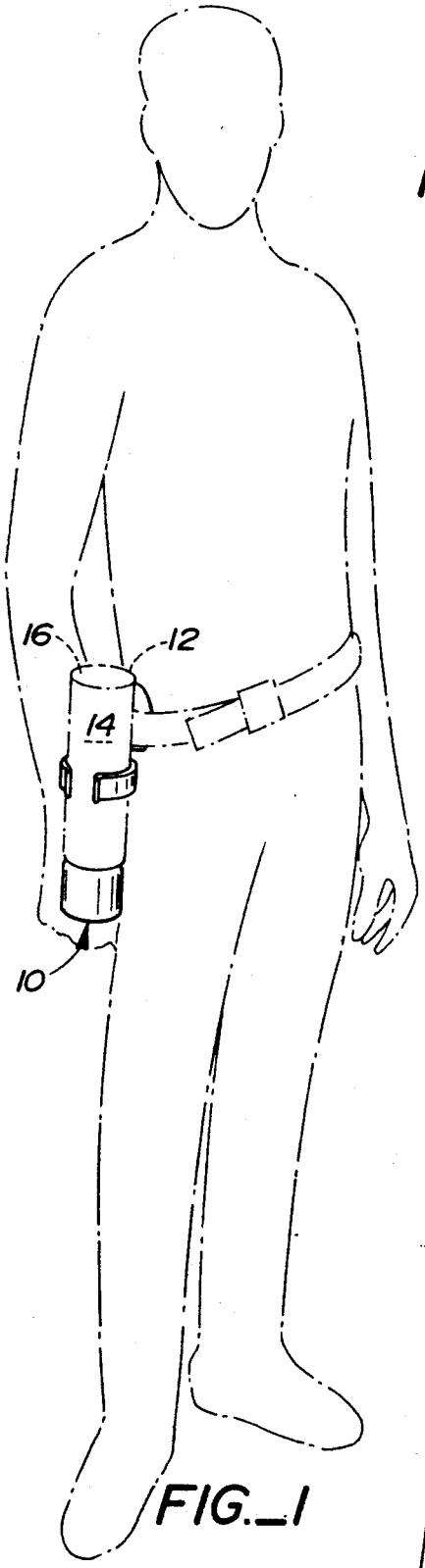
FIG._1
FIG._2
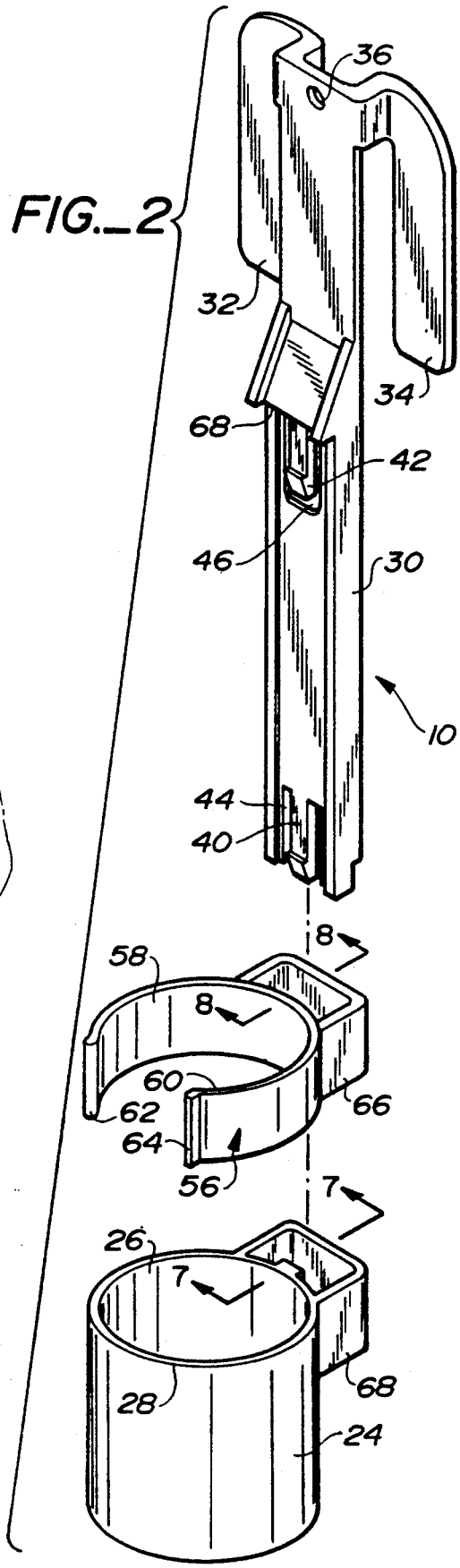

APPARATUS FOR CARRYING A SPRAY CAN

TECHNICAL FIELD

This invention relates to apparatus for carrying a spray can. More particularly, the apparatus is for use by an individual to transport or carry a spray can when the spray can is not being utilized and which allows free and ready access to the spray can when use is desired.

BACKGROUND ART

Spray cans are frequently and commonly employed to mark locations at construction, building, and other sites. The spray paint may, for example, be utilized to mark utility locations or locations where a specific type of task is to be performed. A worker often has to have a spray can at his or her ready disposal throughout the day. This can present difficulties since an individual is normally performing a number of tasks at the job site. If a spray can is simply hand carried it can easily be misplaced.

Some workers have followed the practice of securing a spray can in a conventional tool belt or apron. This approach is not satisfactory because a cap must normally be used on the spray can to prevent its accidental actuation. When one wishes to use the spray can, not only must the can be removed from wherever it is being held but the cap must be removed as well. This is inconvenient and time consuming. The prospective user may only have one hand free because he or she may be carrying out tasks with the other. Also, spray caps are commonly accidentally dislodged from the spray cans, especially when the users are physically active as is virtually always the case in construction and building projects. When the protective caps are no longer in position, accidental actuation of spray can valve elements can, and does, occur.

Applicant is aware of a number of prior art devices which are utilized to carry a variety of articles. For example, U.S. Pat. No. 4,830,247, issued May 16, 1989, discloses a belt-suspended holster for a caulking gun. The lower end of the holster is provided with a nose plate for receiving the applicator tip of the caulking gun. Clasps in the form of resilient arms are fixedly secured to the rest of the holster to engage the cylindrical outer surface of the caulking gun to maintain it in position. Likewise, the nose plate of the holster is fixed in place relative to the rest of the holster by fasteners such as rivets.

With the arrangement of U.S. Pat. No. 4,830,247, the caulking gun may be manually be put into place or removed from the holster from only one direction, that is, from the front of the holster. Furthermore, the nose piece, being an integral and immovable part of the holster, cannot be employed to protect the tip of the caulking gun upon removal of the caulking gun from the holster. The holster of U.S. Pat. No. 4,830,247 is relatively complex and expensive.

Other prior art of which applicant is aware are the following patents: U.S. Pat. No. 1,605,195, issued Nov. 2, 1926, U.S. Pat. No. 3,637,120, issued Jan. 25, 1972, U.S. Pat. No. 4,993,611, issued Feb. 19, 1991, U.S. Pat. No. 4,955,518, issued Sep. 11, 1990, U.S. Pat. No. 969,524, issued Sep. 6, 1910, and Austrian Patent Document No. 181793, dated Apr. 25, 1955. The arrangements shown in this prior art are of even less pertinence to the present invention then that of U.S. Pat. No. 4,830,247, discussed at length above.

DISCLOSURE OF INVENTION

The apparatus of the present invention allows a spray can to be carried by an individual with the conventional protective cap of the spray can removed. Thus, the spray can is readily accessed and utilized. The apparatus is so constructed as to afford protection for the spray valve element of the spray can while it is being carried, so that the valve element is not accidentally actuated. These objectives are carried out by apparatus which is of relatively simple and inexpensive construction.

Another important feature of the apparatus of the present invention relates to removability of certain structural components by the operator. Such feature enables the operator to customize the apparatus so that the spray can may be placed into position on or removed from the apparatus from different locations. This is useful, for example, when the operator wears the apparatus on different sides of his or her body or when the apparatus is being used by a person who is right handed rather than left handed. Furthermore, one of the removable structural components is a receptacle which may be removed from the rest of the apparatus and employed as a conventional closure cap for the removed spray can.

The apparatus of the present invention is for the purpose of carrying a spray can, the spray can having a cylindrical side wall, a first end wall, a second end wall, and a spray valve element projecting from the second end wall.

The apparatus includes an elongated support element as well as a receptacle defining an interior and having an upper rim engageable by the spray can for releasably securing the spray can to the receptacle with the spray valve element positioned in the receptacle interior.

First attachment means is provided for releasably attaching the receptacle to the elongated support element at a first predetermined location on the elongated supported element.

Also included in the apparatus are spray can retention means and second attachment means for releasably attaching the spray can retention means to the elongated support element at a second predetermined location on the elongated support element spaced from the first predetermined location.

The spray can retention means when releasably attached to the elongated support element at the second predetermined location is operatively associated with the receptacle when the receptacle is attached to the elongated support element at the first predetermined location to releasably retain the spray can in a generally vertical condition with the spray can side wall adjacent to the elongated support element and positioned above the rim and the spray valve disposed downwardly and within the interior of the receptacle.

Each of the first and second attachment means includes a flexible lock element connected to the elongated support element and having an abutment surface. The abutment surfaces are engageable with the receptacle and the spray can retention means to prevent movement of the receptacle and the spray can retention means relative to the elongated support element when the lock elements are in a first, unflexed condition and disengageable from the receptacle and the spray can retention means to allow movement of the receptacle and the spray can retention means relative to the elongated support element when the lock elements are in a second, flexed condition.

A plurality of spaced support arms are affixed to the elongated support element. The elongated support element has a back side and the spaced support arms extend downwardly in a plane offset from and generally parallel to the back side whereby the apparatus may depend from an object positioned between the back side and the spaced support arms.

The spray can retention means includes a spray can retention member having a pair of resilient arms with spaced distal ends. The arms frictionally engage the spray can during retention thereof by the arms.

The apparatus includes a plurality of spray can retention members for selective and interchangeable releasable attachment to the elongated support element, each spray can retention member having arms which differ from the arms of the other of the retention members whereby a spray can may be applied to or removed from the apparatus from different locations relative to the elongated support element.

Other features, advantages, and objects of the present invention will become apparent with reference to the following description and accompanying drawings.

BRIEF DESCRIPTION OF DRAWINGS

FIG. 1 is a perspective view showing apparatus constructed in accordance with the present invention being carried on the belt of an individual and holding a spray can, the belt, the individual and the spray can being depicted in phantom lines;

FIG. 2 is an exploded, perspective view of apparatus constructed in accordance with the teachings of the present invention illustrating components thereof relatively positioned prior to assembly of the apparatus;

BEST MODE FOR CARRYING OUT THE INVENTION

Figure 3:
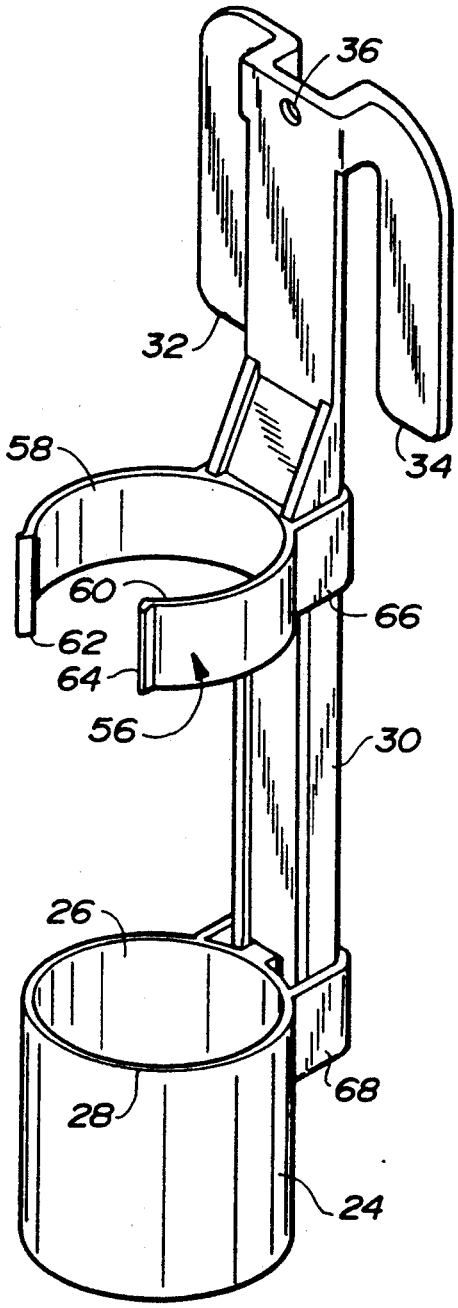
FIG. 3 is a perspective view of the apparatus in assembled condition.

Referring now to FIGS. 1–3 and 5–8 of the drawings, apparatus constructed in accordance with the teachings of the present invention is generally designated by reference numeral 10. Apparatus 10 is for the purpose of carrying a spray can 12 (FIG. 1). As is conventional, the spray can 12 has a cylindrical side wall 14, a first end wall 16, a second end wall, and a spray valve element projecting from the second end wall. The spray can 12 is of conventional construction so the second end wall and the spray valve element have not been illustrated; however, it will be appreciated that the spray valved element is actuated by depression or deflection by the user when hand held by him or her.

Apparatus 10 includes a receptacle 24 of a cup-like configuration and defining an interior 26. Although not illustrated, the receptacle 24 is closed at its bottom by a bottom wall. The receptacle has an upper rim 28 disposed along a circle having a circumference of lesser magnitude than the magnitude of the circumference of the spray can cylindrical side wall 14.

Apparatus 10 also includes an elongated support element 30 having a back side.

A pair of spaced support arms 32, 34 are integral with the elongated support element 30 and extend downwardly in a plane offset from and generally parallel to the back side of the elongated support element so that an object such as a belt may readily be accommodated thereby to provide support for the apparatus and spray can retained therein. Spacing between the elongated support element and the support arm should be enough to accommodate a relatively thick belt. In any event, the support arms have a degree of flexibility which will accommodate belts of different thickness and size. An aperture 36 is formed in the elongated support element so that apparatus, if desired, may be held on a wall or other support by a nail or screw when not being worn.

Connected to elongated support element 30 at spaced locations thereon are flexible lock elements 40, 42. As is the case with support arms 32, 34, lock elements 40, 42 are integral with the elongated support element. Preferably, the support arms and lock elements are of a single molded piece along with the elongated support element. Any suitable material may be utilized in such construction, but plastic such as polypropylene is preferred to allow manufacture by injection molding.

The lock elements 40, 42 are connected to the elongated support element 30 at their respective upper ends with the lower portions of the lock elements being located at slots 44, 46 formed in the elongated support element. Thus, the lower distal ends of the lock elements may be flexed relative to the elongated support element.

Each flexible lock element has an abutment surface 48 at the enlarged distal end thereof. Each enlarged distal end further defines a cam surface 50 leading upwardly to its associated abutment surface 48.

Another component of the apparatus of the present invention is retention means in the form of a curved band 56 having spaced resilient arm or band segments 58, 60. In the arrangement shown in FIGS. 1–3 and 5–8, arms 58, 60 are of equal length and have curved distal ends 62, 64, respectively, defining an opening therebetween.

Integral with curved band 56 is guide means in a form of a rectangular sleeve 66. When assembling apparatus 10, sleeve 66 is slid over elongated support element 30 until the bottom of curved band 56 is over abutment surface 48 of lock element 42 (see FIG. 8). The cam surface 50 of that lock element enables the retention means to deflect lock element 42 when being placed into position and the lock element 42 snaps back into place when the retention means is in place. Likewise, the lock element 40 provides no hindrance to upward movement of the retention means because of its deflection also. When the retention means 66 is in place, it abuts a stop element 68 at the upper end of the elongated support element. Preferably retention means 56 is formed of the same material as the elongated support element.

Next, the receptacle 24 is positioned in place. Receptacle 24 has a sleeve 68 attached thereto which receives the lower end of the elongated support element. An enlargement 70 projecting from the receptacle into the interior of sleeve 68 abuts against abutment surface 48 of lock element 40 to prevent downward movement of the receptacle and a ledge 72 abuts against the bottom of elongated support element 30 to prevent further upward movement of the receptacle.

After apparatus 10 has been assembled, the spray can 12 is inserted into curved band 56, the resilient arms thereof first accommodating the can as it passes between the distal ends thereof and then engaging the outer periphery of the can. The can is then slid down into position on the receptacle which is preferably sized to snap into place on the can in the manner of conventional spray can covers. It will be appreciated that the spray can be readily removed from the apparatus when desired.

The receptacle 24 and the retention means 56 may readily be removed from the elongated support element by manually deflecting inwardly the distal ends of lock elements 40, 42. The receptacle 24 may serve as a cover for the spray can in its own right, if desired, once removed from the elongated support element.

Figure 4:
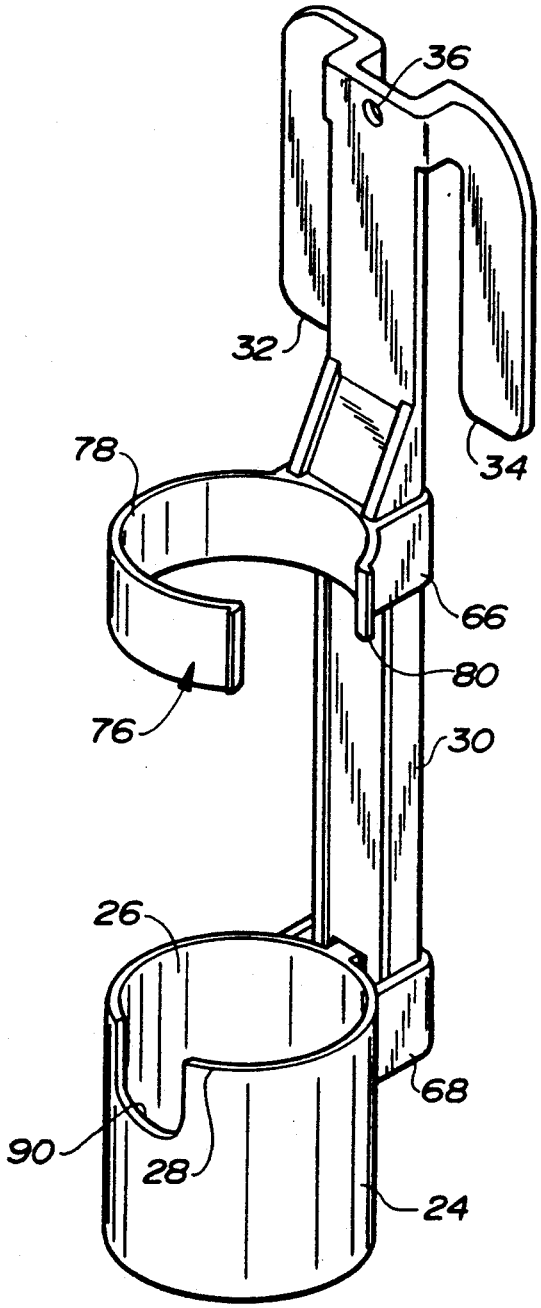
FIG. 4 is a view similar to FIG. 2 but illustrating an alternative form of spray can retention means employed on the apparatus.
Figure 5:
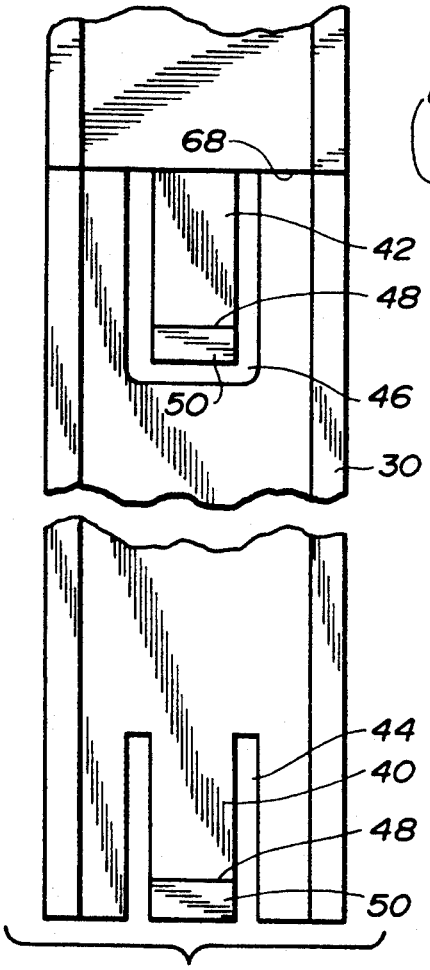
FIG. 5 is an enlarged frontal view of a portion of the apparatus elongated support element.
Figure 6:
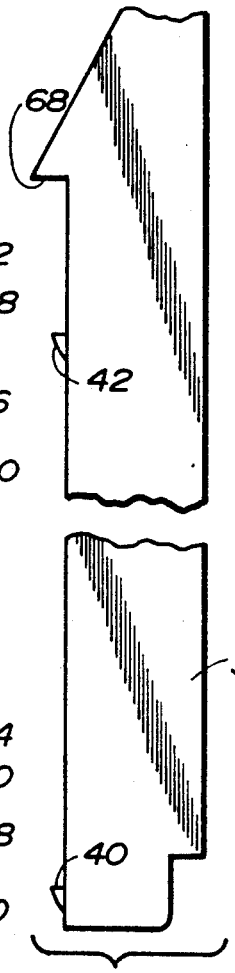
FIG. 6 is an enlarged side view of the portion shown in FIG. 5.
Figure 8:
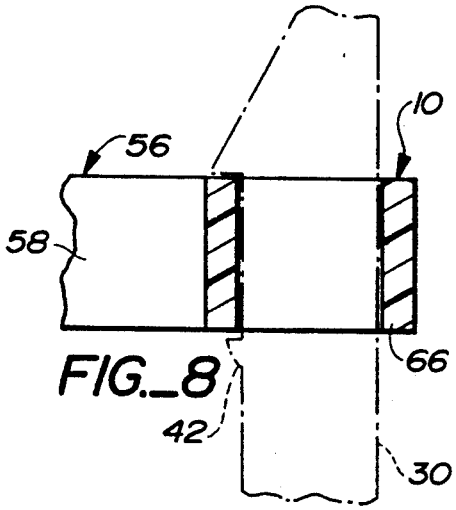
FIG. 8 is an enlarged sectional view taken along line 8—8 of FIG. 2.
Figure 7:
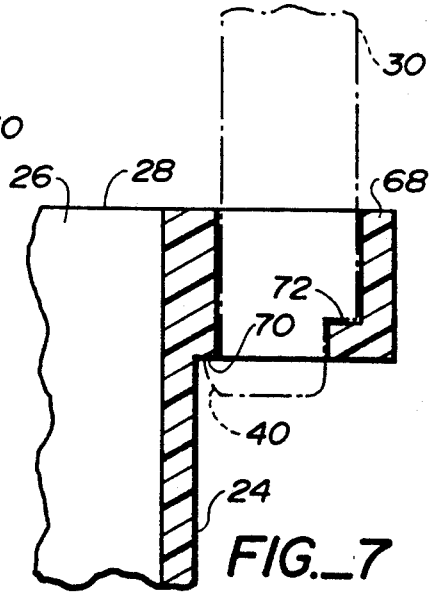
FIG. 7 is an enlarged sectional view taken along line 7—7 of FIG. 2.

In the form of the apparatus shown in FIG. 4, retention means 76 is shown. The elongated support element 30 and the receptacle 24 are precisely as previously described. Retention means 76 differs from retention means 56 in that it has a long resilient arm 78 and a short resilient arm 80. Such an arrangement allows the spray can to be directed into position on the apparatus from the right side as viewed in FIG. 4. It will be appreciated that a reverse arrangement for the retention means will allow the spray can to be placed into position or removed from the left. It will thus be seen that the apparatus of the present invention can be readily modified to provide a configuration which is most convenient for the user. The FIG. 4 embodiment also differs in that a notch 90 is formed in receptacle 24. Notch 90 is sized and configured to accommodate an actuator handle (not shown) sometimes employed on spray cans.

What is claimed is:

1. Apparatus for carrying a spray can, said spray can having a cylindrical side wall, a first end wall, a second end wall, and a spray valve element projecting from said second end wall, said apparatus comprising:

an elongated support element;

a receptacle defining an interior and having an upper rim engageable by said spray can for releasably securing said spray can to said receptacle with the spray valve element positioned in said receptacle interior;

first attachment means for releasably attaching said receptacle to said elongated support element at a first predetermined location on said elongated support element;

spray can retention means; and second attachment means for releasably attaching said spray can retention means to said elongated support element at a second predetermined location on said elongated support element spaced from said first predetermined location, said spray can retention means when releasably attached to said elongated support element at said second predetermined location being operatively associated with said receptacle when said receptacle is attached to said elongated support element at said first predetermined location to releasably retain said spray can in a generally vertical condition with the spray can side wall adjacent to said elongated support element and positioned above said rim and the spray valve disposed downwardly and within the interior of said receptacle, each of said first and second attachment means including a flexible lock element connected to said elongated support element and having an abutment surface, said abutment surfaces engageable with said receptacle and said spray can retention means to prevent movement of said receptacle and said spray can retention means relative to said elongated support element when said lock elements are in a first, unflexed condition and disengagable from said. receptacle and said spray can retention means to allow movement of said receptacle and said spray can retention means relative to said elongated support element when said lock elements are in a second, flexed condition.

2. The apparatus according to claim 1 wherein each of said flexible lock elements includes a movable, enlarged distal end defining said abutment surface, each said movable, enlarged distal end further defining a cam surface leading to said abutment surface, said flexible lock element cam surfaces being engageable by said receptacle and said spray can retention means to flex said lock elements during installation of said receptacle and said spray can retention means on said elongated support element.

3. Apparatus according to claim 2 additionally comprising guide means connected to each of said receptacle and said spray can retention means slidably engageable with said elongated support element and cooperable with said elongated support element to maintain said retention means above said receptacle and said retention means and said receptacle against pivotal movement relative to said elongated support element.

4. The apparatus according to claim 1 wherein said flexible lock elements are integral with said elongated support element.

5. The apparatus according to claim 1 additionally comprising a plurality of spaced support arms affixed to said elongated support element, said elongated support element having a back side and said spaced support arms extending downwardly in a plane offset from and generally parallel to said back side whereby said apparatus may depend from an object positioned between said back side and said spaced support arms.

6. The apparatus according to claim 1 wherein a first stop element is connected to said receptacle to engage said elongated support element and prevent upward movement of said receptacle relative thereto when said receptacle is at said first predetermined location.

7. The apparatus according to claim 1 wherein a second stop element is connected to said elongated support element to engage and prevent upward movement of said spray can retention means relative to said elongated support element when said receptacle is at said second predetermined location.

8. The apparatus according to claim 1 wherein said spray can retention means includes a spray can retention member having a pair of resilient arms with spaced distal ends, said arms frictionally engaging said spray can during retention thereof by said arms.

9. The apparatus according to claim 8 including a plurality of spray can retention members for selective and interchangeable releasable attachment to said elongated support element, each spray can retention member of said plurality of spray can retention members having arms which differ from the arms of the other of said plurality of spray can retention members whereby a spray can may be applied to or removed from said apparatus from different locations relative to said elongated support element.

* * * * *